US008437872B2

(12) United States Patent
Prataiola

(10) Patent No.: US 8,437,872 B2
(45) Date of Patent: May 7, 2013

(54) APPARATUS FOR THE DISTRIBUTION OF CARDS ON PAPER CARRIERS AND RELATED ENVELOPING APPARATUS

(75) Inventor: Alessandro Prataiola, Sansepolcro (IT)

(73) Assignee: Kern Sistemi S.r.l., Assago (IT)

( * ) Notice: Subject to any disclaimer, the term of this patent is extended or adjusted under 35 U.S.C. 154(b) by 634 days.

(21) Appl. No.: 12/529,609

(22) PCT Filed: Mar. 3, 2008

(86) PCT No.: PCT/IB2008/050770

§ 371 (c)(1),
(2), (4) Date: Dec. 15, 2009

(87) PCT Pub. No.: WO2008/107839

PCT Pub. Date: Sep. 12, 2008

(65) Prior Publication Data

US 2010/0179680 A1 Jul. 15, 2010

(30) Foreign Application Priority Data

Mar. 2, 2007 (IT) ..... RM2007A0113

(51) Int. Cl.

| | |
|---|---|
| ***G05B 19/18*** | (2006.01) |
| ***G06F 7/00*** | (2006.01) |
| ***B65G 19/26*** | (2006.01) |
| ***B65G 19/00*** | (2006.01) |
| ***B65G 15/00*** | (2006.01) |

(52) U.S. Cl.

USPC ..... 700/213; 700/214; 700/220; 700/221; 700/223; 700/224; 198/732; 198/728; 198/836.1

(58) Field of Classification Search ..... None
See application file for complete search history.

(56) References Cited

U.S. PATENT DOCUMENTS

| | | | | |
|---|---|---|---|---|
| 5,058,873 | A | 10/1991 | Hewitt et al. | |
| 5,538,232 | A * | 7/1996 | Long | 270/1.03 |
| 2002/0056959 | A1 * | 5/2002 | Ference | 271/112 |
| 2002/0056969 | A1 * | 5/2002 | Sawai et al. | 280/124.146 |
| 2003/0155419 | A1 * | 8/2003 | Bretl et al. | 235/440 |
| 2008/0135172 | A1 * | 6/2008 | Prochut et al. | 156/281 |

FOREIGN PATENT DOCUMENTS

| | | |
|---|---|---|
| AT | 412 154 | 10/2004 |
| EP | 0 361 989 | 4/1990 |
| GB | 2 087 361 | 5/1982 |
| JP | 09 212593 | 5/1991 |

OTHER PUBLICATIONS

International Search Report dated Feb. 26, 2009, from corresponding PCT application.

* cited by examiner

*Primary Examiner* — Gene Crawford
*Assistant Examiner* — Yolanda Jones
(74) *Attorney, Agent, or Firm* — Young & Thompson

(57) ABSTRACT

An apparatus (4) for the distribution of cards on paper carriers allows easier control and reading steps on the cards, without slowing down the coupling process, and includes a card conveying line, on which are provided: a first section (44) wherein the cards (100) translate in a substantially vertical arrangement, the apparatus (4) including at least one card control and/or reading station (41) thereat; and a second section wherein the cards translate in a substantially horizontal arrangement and wherein an element for coupling (49) cards to a paper carrier is operated.

27 Claims, 4 Drawing Sheets

APPARATUS FOR THE DISTRIBUTION OF CARDS ON PAPER CARRIERS AND RELATED ENVELOPING APPARATUS

The present invention is related to an apparatus for the distribution of cards on paper carriers and to an enveloping apparatus incorporating the latter.

Here and in the following, with the term "card" it is understood a substantially stiff card, having a rectangular shape, made of plastics or of another plasticized material, usually carrying identification data. Credit cards, debit cards, calling cards, customer loyalty cards identifying a consumer to a provider of products or services, smart cards and so on are related to such definition.

Usually this card has a format defined according to ISO standard 7810, 7811, 7813, 7816, 14443 or a format A7, A8, B7, B8, C7, C8 according to ISO standard 216. Identification data can be provided in the form of a magnetic strip, a chip, a RFID tag, alphanumeric characters, a bar code, characters according to the MRTD standard. This format of card can be also used for optical or magnetic devices as Compact Disk or DVD. Also toy cards, collection cards, business cards, data cards, badges, key cards e.g. for hotel rooms etc. are known, all of them having a substantially limited degree of flexibility.

Embodiments of cards made of paperboard, metal sheet and combined materials are known and must be included in the present definition of card, as long as they are provided with a laminated shape.

Generally, such cards are mailed on a paper carrier being attached to the latter by means of glue, biadhesive tape, or by framing into suitable notches as well. The paper carrier, in turn, is enveloped. The recipient address is printed on the paper carrier and/or on the mail envelope. The carrier, and possibly the envelope, contain also identification data which may allow the coupling with the intended card.

The paper carriers have an exposed area on which one or more cards are laid, particularly when it is provided that more cards are mailed on a single carrier. Further, it can be provided that among the carriers information sheets are inserted, the latter not receiving cards but undergoing the same steps of feeding, printing, creasing, bending of the carriers, to be mailed all together.

In the apparatuses of the present invention, the cards are fed to a first conveying line by suitable feeder, while the paper carriers are fed through a second conveying line to a card-paper carrier coupling station. On both the conveying lines reading stations are provided of the identification data for assuring that the lines themselves are synchronized and that the coupling between card and respective carrier be error-proof, since a wrong coupling may lead to serious consequences in consideration of the delicacy and the importance of the personal data contained in the cards.

Although systems exist assuring a correct coupling, they can limit the card-paper carrier coupling speed. Such limitation may slow down the whole production and mailing process of cards and related paper carriers.

The technical problems underlying the present invention is to provide an apparatus for the distribution of cards on paper carriers allowing to obviate to the drawback mentioned with reference to the prior art.

SUMMARY OF THE INVENTION

Such problem is solved by an apparatus as above specified, characterized in that it comprises a card conveying line on which are provided:

a first section wherein said cards translate in a substantially vertical arrangement, the apparatus comprising at least one card control and/or reading station thereat; and a second section wherein said cards translate in a substantially horizontal arrangement and wherein means for coupling cards to a paper carrier is operated.

The main advantage of the apparatus according to the present invention lies in allowing easier control and reading steps on the cards, without slowing down the coupling process.

It is understood that the present invention is referred also to an enveloping apparatus incorporating an apparatus for the distribution of cards on paper carriers as previously defined.

BRIEF DESCRIPTION OF THE DRAWINGS

The present invention will be describe in the following, according to an embodiment thereof, given with an exemplificative and non limitative purpose with reference to the annexed drawings wherein.

DETAILED DESCRIPTION OF THE PREFERRED EMBODIMENTS

Figure 1:
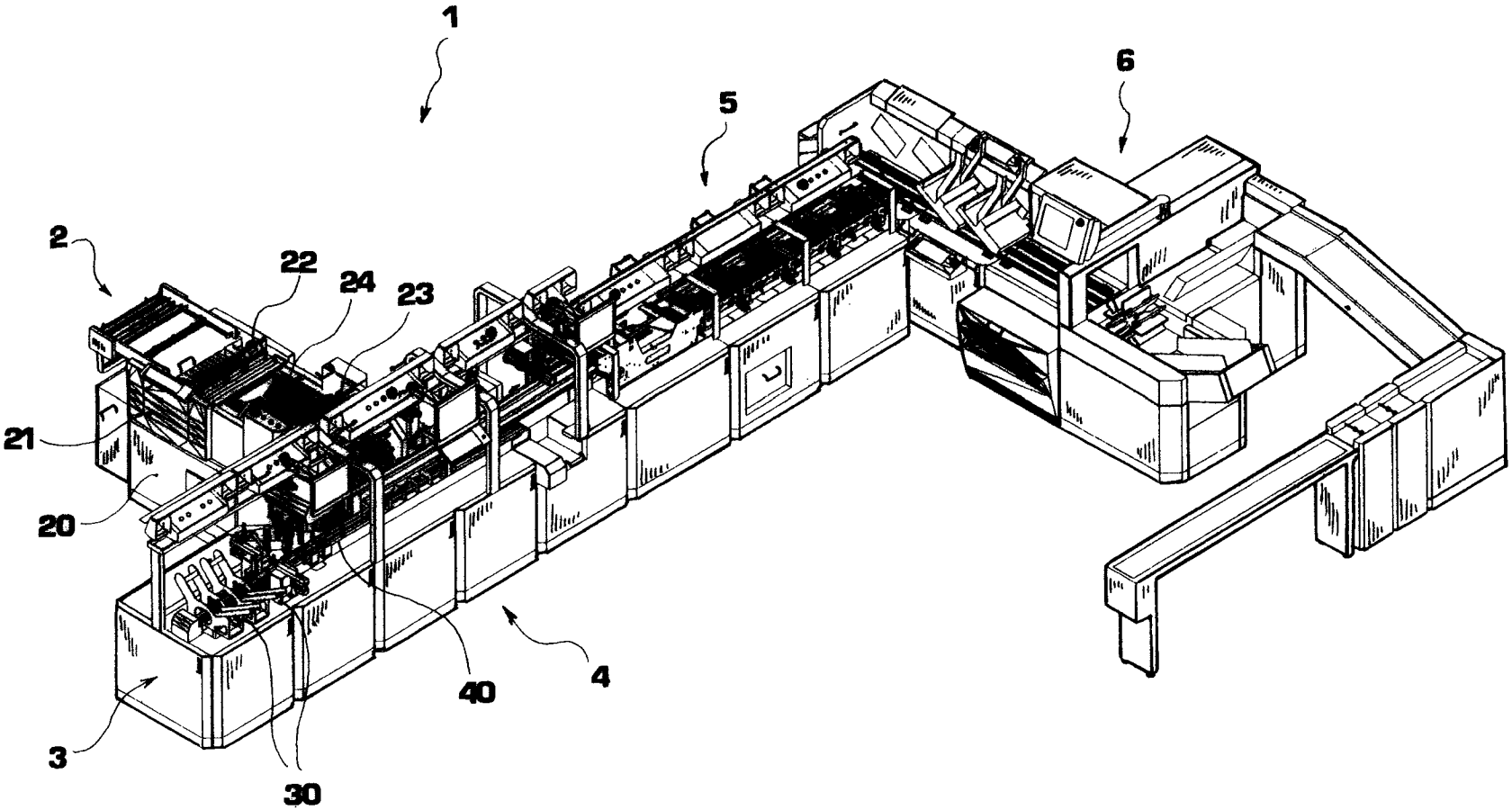
FIG. 1 shows an isometric perspective view of an enveloping apparatus incorporating a distribution apparatus according to the invention.
Figure 2:
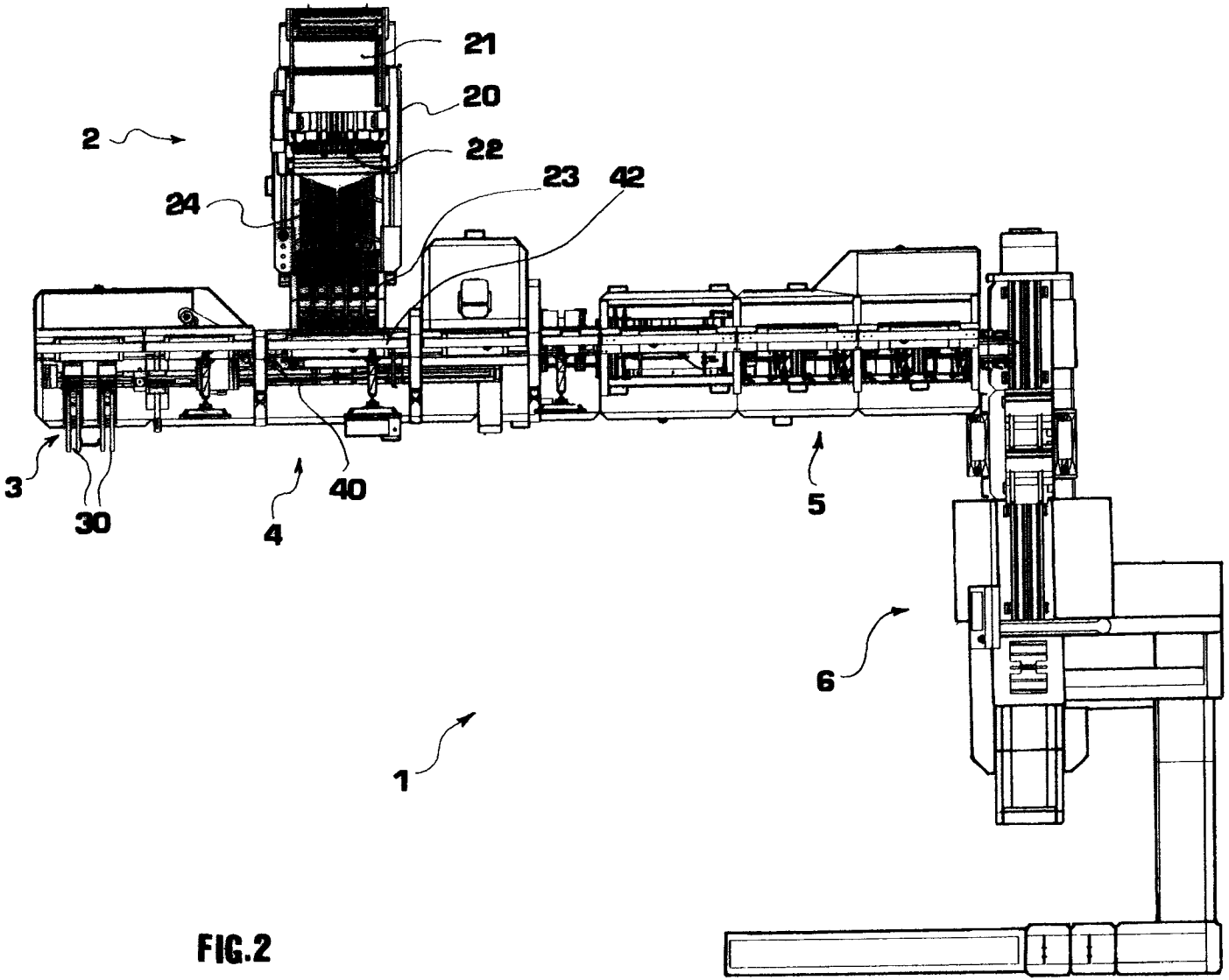
FIG. 2 shows a top view of the enveloping apparatus of FIG. 1.

In connection with the drawings, an enveloping apparatus for paper carriers, information sheets and cards is globally indicated as 1. It is understood that this expression indicates the apparatus operating the whole assembly of said elements, and possibly also printing stations, envelope-making stations and so on.

It can be substantially and generally divided in a set of sub-apparatuses, particularly a paper carrier feeding station 2, a card feeding station 3, an apparatus 4 for the distribution of cards on said paper carrier, a folding station 5 and an enveloping station 6 of substantially conventional type.

The paper carrier feeding station 2 operates the task o providing the distribution apparatus with a discrete sequence of paper carriers 7 in the shape of sheets, possibly spaced by information sheets 9.

It is understood that, for each paper carrier 7, not only the presence of the information sheet is optional, but the number of information sheets may be variably carrier by carrier.

The station 2 may comprise either a printing device 2 acting on discrete sheets, on endless form sheets, or on a paper bobbin as well, or a simple feeder device of single pre-printed and stacked sheets.

In the present embodiment, this station comprises a feeder device 20 for an endless form 21 composed by paper sheets and by information sheets obtained from a single sheet, which is separated by a cutting device 22 acting longitudinally and transversally and by a roller conveyor 24 transversally spacing away the two cut sheets.

Moreover, this station 2 comprises, following the route of the paper carriers, a first folding station 23, particularly of the roller-type, producing on the paper carriers and on the information sheets folding lines for a subsequent folding, preceding the actual enveloping.

The goal of this folding step is to hide, folding it back, a portion not intended to receive a card on the surface thereof. However, it is understood that, in a simplified embodiment, this folding step may be operated together with the following ones preceding the enveloping. Further, they become superfluous when the carrier has a shape and/or a grammage so as to not require a folding.

In the present embodiment, only a folding is operated, transversal to the conveying direction of the carriers 7, while generally the folding lines are formed parallel.

In the present embodiment, the paper carrier 7 is already folded so as to provide an exposed area 8 on which one or more cards will be laid. The information sheet 9, intended to be enveloped with the paper support, undergoes the same folding.

In this way, it is possible to close up the line of carriers 7 and sheets 9. They are then laid in a sequence on a conveying line which will be detailed in the following.

The card feeding station 3 comprises one or more card feeder device 20, arranged in a sequence, each of them comprising a stacking 31 of cards. In each stacking 31, the cards, singularly indicated as 100, can be already arranged according to the order in which they will be distributed on the receiving paper carriers 7.

If the arrangement is ordered, progressively or regressively, the coupling with the receiving carrier 7 is directly provided.

Otherwise, if the arrangement is random, it will be possible to detect, through suitable means, the code of each card and, consequently, to operate on printing means adding the required variable data to the carrier, e.g. the recipient address.

The printing may occur upstream or downstream with respect to the coupling between card and carrier.

The cards can be fed horizontally or vertically on a first conveying line 40, made of suitable rails 32, of an apparatus 4 for the distribution of cards on said paper carrier.

Such card conveying line extends from said card feeder device 30 to means for coupling cards and receiving paper carrier 7.

Side by side, the distribution apparatus 4 comprises a paper carrier second conveying line 42, receiving the paper carriers from said feeding station 2. In this second line 42, the translation of the paper carriers is obtained through pushing members 43 connected to a suitable belt, not shown in the drawings.

At said first conveying line 40, the cards are pushed by suitable pushing members 33 connected to a suitable belt, not shown in the drawings, and they are kept in the translation arrangement thereof by C-section rails housing the top and bottom edges of each card, parallel to the conveying direction.

It is understood that, if the cards 100 are fed horizontally, they are first rested on L-section rails then varying themselves in C-section rails 32. Otherwise, suction extractors may be provided directly inserting the cards into the receiving guide rails.

The pushing members 33 of the cards are L-shaped, so as to push the cards 100 both when they are horizontally and vertically arranged.

In the first card conveying line 40, a first section 44 is identified, wherein said cards translate in a substantially vertical arrangement, the apparatus 4 comprising at least one card control and/or reading station thereat, indicated 41 as a whole, which will be detailed in the following.

The cards 100, stacked inside the respective feeder device 30, when regressively arranged in a stacking 31, require that the stacking is arranged upside down inside the feeder, then the cards are inserted upturned in the respective conveying line 40.

To face this last possibility, the conveying line 40 can comprises a turning device 47 to turn upside down each card, comprising means for holding one card 100 between four pairs of wheels mounted on a supporting plate revolving of 180°, in case of entry of a card from a regressively ordered stacking.

In the revolving, the card 100 is kept in a vertical arrangement and the nit is inserted in C-section guide rails 32, for having the translation thereof continued. After this device, the cards 100 show a front surface, remaining exposed after the deposition on the paper carrier 7, turned ahead according to a common direction, and a back surface, intended to touch the carrier 7.

After, the line 40 has said first reading station 41, with control duties As a matter of fact, such station comprises an optical recognition system on both the sides of the card, with a pair of optical reader 51 apt to read bar codes, alphanumeric strips or further codes as well, e.g. MRTD-type codes. In this embodiment, the optical recognition system comprises a pair of digital optical readers 51, controlled through a code recognition software. A suitable lighting may be provided, particularly for highlighting predetermined characters printed in a particular way or relieved.

Further, this station comprises a magnetic strip reading device 45, of the sliding type, and at least one chip reader device 46 for smart cards, provided in a pair in the present embodiment, to be more rapidly operated alternatively.

Optionally, a RFID-type reading device can be provided.

At the reading station 41, the cards 100 can be moved step-by-step to allow a correct reading, particularly for the sensors of the chip reading device 46 for smart cards, requiring to touch the chip for a certain time.

To ease the correct arrangement, the C-section guide rail are mounted on elastic supports, non shown in the drawings, pressing at least one branch of the guide against one edge of the card 100. In this way, when the pushing member 33 is stopped, the card is immediately blocked by friction without having the path thereof obstructed.

Following to said first section 44, the first conveying line 40 comprises a second section 48 wherein said cards 100 are translated in a substantially horizontal arrangement, wherein means for coupling 49 the cards to a receiving paper carrier is operated.

The vertical arrangement of the cards 100 makes easier the application of an adhesive element and the solving of possible problems of jamming.

The transition between the sections 44, 48 is provided by the continuity of the guide rails 32 following a helical sector suspended by clamps 52.

In the present embodiment, advantageously said coupling means are composed by a pick-and-place device, apt to capture, e.g. by a suction system, one or more cards 100 and to lay down them on the exposed surface 8 of the paper carrier 7. To this purpose, it is underlined that the conveying lines 40, 42 are parallel along the same direction, so as that the cards 100 and the paper carriers 7 put forward step by step or continuously.

At such device, the cards 100 slide along guide rails 53 having a L-shaped section upwardly open. To prevent that cards 100 be able to move in an undesired way, below them and at the second section 48, a foraminated plate 48 (not shown) through which the cards are sucked by pneumatic vacuum, anyway so as to not hinder the pick-and-place device action.

Figure 3:
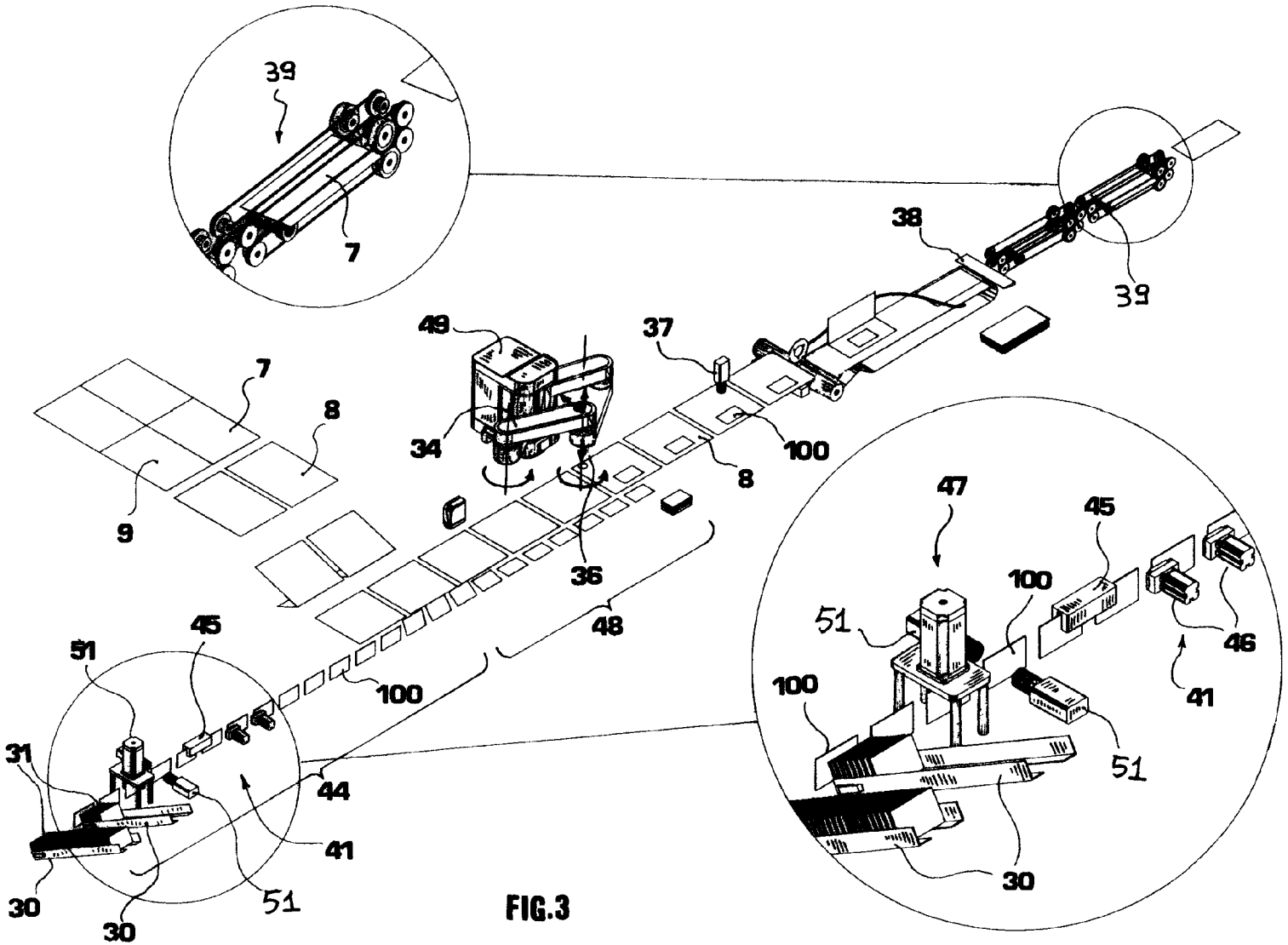
FIG. 3 schematically illustrates the operation of the distribution apparatus according to the invention.
Figure 4:
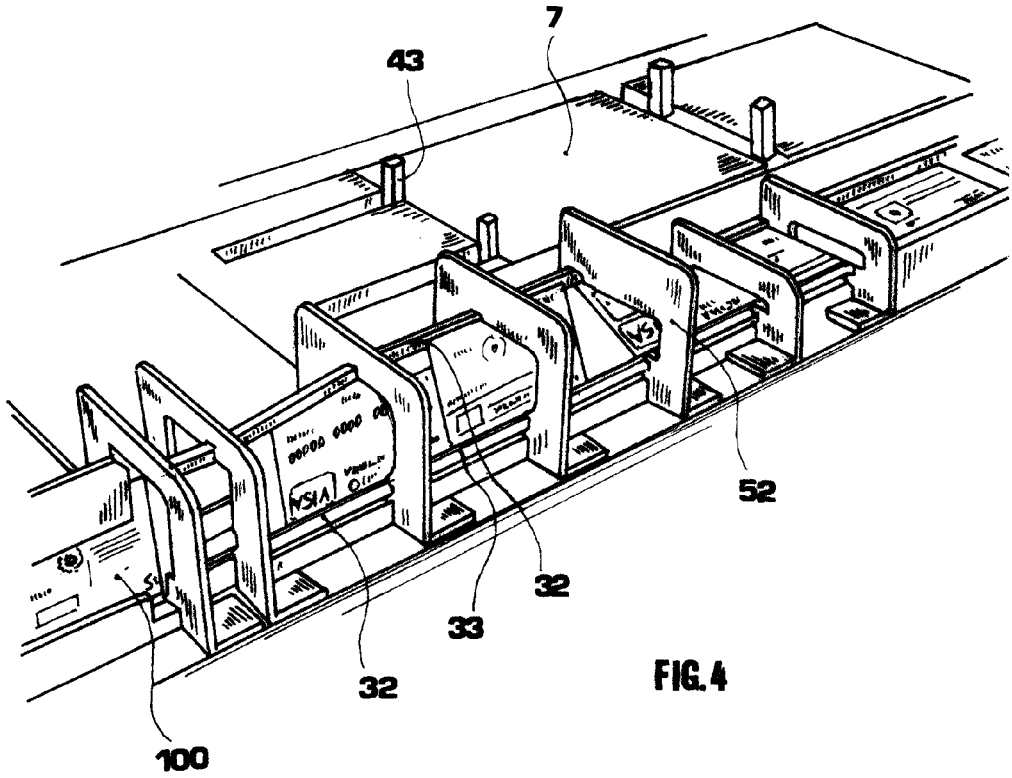
FIG. 4 shows a perspective view of a first detail of the apparatus of FIG. 3.
Figure 5:
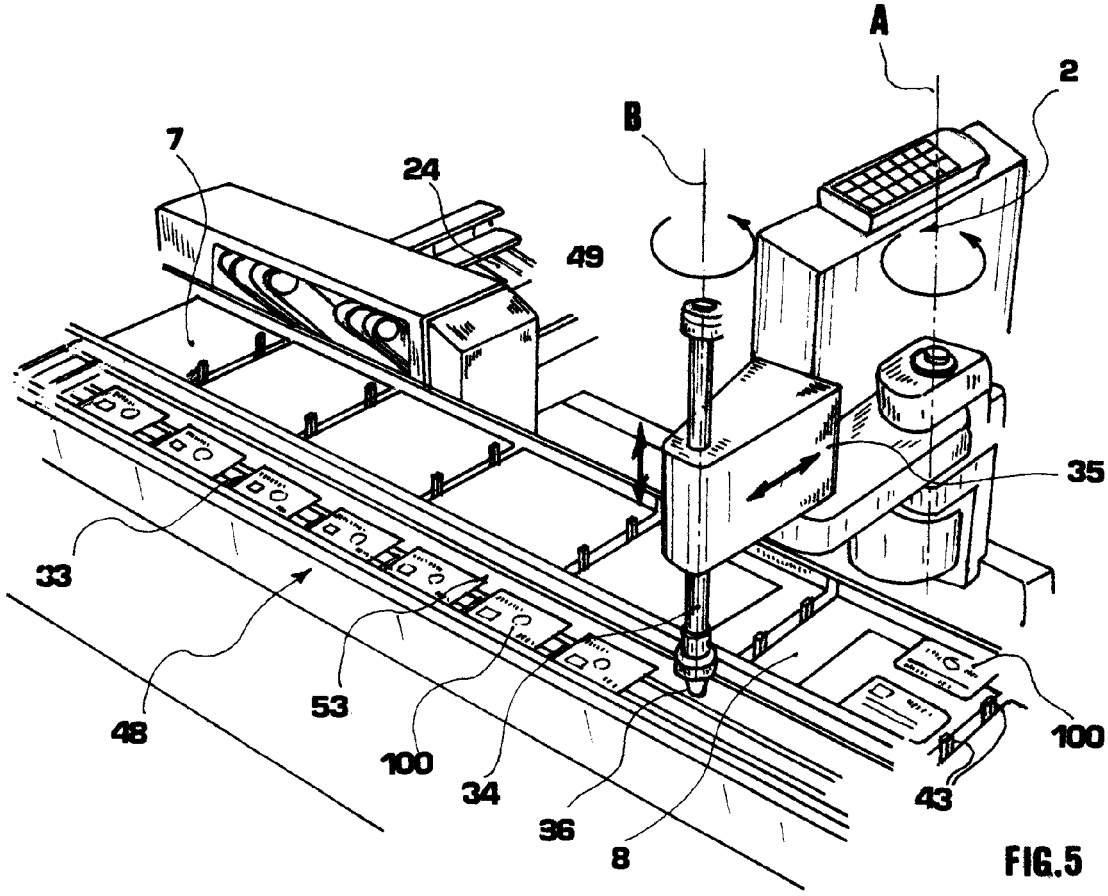
FIG. 5 shows a perspective view of a second detail of the apparatus of FIG. 3, but including a modification.

The pick-and-place device comprising an arm 35 revolving around a first axis A, having a variable length. Such arm 35 may be of telescopic type or, in a more simplified and effective way, it may comprise two hinged half-arms (FIG. 5) or two pairs of hinged half-arms in a parallelogram configuration (FIG. 3).

The working end of the arm 35 comprises a picking member 36 arranged on a sliding vertical bar 34, so as that the picking element be able to vertically translate along a second axis B. The vertical bar 34 is also pivotable, so as that the card 100, after the picking thereof, can be rotated of 360°.

Therefore, said device has two vertical rotation axis A, B, parallel but distinct to each other—variable length arm movable on a horizontal plane and a picking member able to translate vertically.

The combination of these degrees of freedom makes the pick-and-place device suitable to pick one or more cards and to lay down them on the paper carrier 7 in any point of the exposed surface 8, with any angle.

The coupling can be operated both when the carriers are moved step-by-step and when they are moved continuously and in such a case the pick-and-place device can follow the paper carrier and lay down the card or the cards in the appropriate position.

It is understood that on the information sheet no cards have to be laid down. Further, the above described pick-and-pace device can be used also for rejecting defective cards, turned on the wrong side or not inserted into the line according to the required order. The rejected cards can be laid down in a suitable collection tray.

The path of the picking member is programmed so as to end the race thereof with a vertical segment, at least with respect to the carrier 7, stopped or moving.

In this way, the glue point the adhesive element on the back side of the card 100 is not dragged on the surface of the receiving carrier 7.

Following to the coupling means, the apparatus 4 comprises a second control and reading station, provided with optical means 37 verifying the correctness of the operated coupling. Downstream of this check, a second folding station 5 is provided, apt to complete the folding of the paper carrier 7 and the forwarding thereof to the enveloping station 6. The folding is conventionally operated.

Between the folding station 5 and the enveloping station an expulsion device 38 is provided for the carriers having a wrong coupling, working with a flap arranged transversally with respect to the conveying direction of the carriers 7, and one or more buffers 39. In this embodiment, the flap is raised to prevent the passage of carriers and cards incorrectly coupled, or containing previously detected errors. The rejected material is accumulated in a collection tray.

The buffers 39 are operated for synchronizing the flow of carriers 7 and the flow of envelopes. Further, they allow to accumulate more carriers 7 intended to be enveloped together.

The apparatus for distribution 4 is controlled by a control system provided with a data storage containing a database with the data of the cards combined with the addresses of the intended recipients.

According to these pieces of information, it is eventually possible to generate printings on the carriers 7 and on the information sheet, verifying that all the cards 100 have been supplied on the respective line 40 according to the required order, corresponding to that of the carriers 7, and verifying the correctness of the operated coupling. On the basis of these pieces of information, it is also possible to coordinate the coupling among carriers, information sheets, possible inserts and envelopes, particularly when the latter are not provided with an address window or when they are printed by the apparatus.

Thanks to these pieces of information, it is possible to simultaneously couple different cards for different recipients, with the best flexibility. Further, each carrier can receive any number of cards and it can be folded, before or after the card deposition, in any possible way.

For instance, it is possible to apply 4 or 8 cards on one side of a A4 format sheet, or to produce a booklet folding a more extended carrier and possibly adding to the apparatus further stations of binding and trimming, However, it is understood that the above described apparatus for the distribution can be managed in a simpler way, i.e. following the sequence order of the cards and of the carriers so as they are fed in parallel. Such configuration, preserving the advantages of the present invention, can be e.g. used for mailing generic and not registered cards to a list of predetermined recipients.

To the above described apparatus for the distribution of cards on paper carrier and enveloping apparatus incorporating the latter a man skilled in the art, to meet further and contingent needs, can yield several additional variants and changes, anyway all falling within the protection scope for the present invention, as defined by the annexed claims.

The invention claimed is:

1. An apparatus for the distribution of cards on paper carriers, comprising:

a card conveying line, that comprises:

a first section wherein said cards translate in a substantially vertical arrangement, the apparatus comprising at least one card control and/or reading station thereat;

a second section wherein said cards translate in a substantially horizontal arrangement and further comprising a means for coupling cards to a receiving paper carrier; and a turning device to turn upside down each card, comprising means for holding one card and a supporting plate capable of revolving 180°, wherein the card is kept in a vertical arrangement during the revolving thereof.

2. The apparatus for the distribution according to claim 1, comprising a second conveying line of paper carriers, and receiving the latter from a feeding station.

3. The apparatus for the distribution according to claim 1, wherein the cards along said conveying line are kept in the translation arrangement thereof by C-section guide rails in which the bottom and the top edges of each card are inserted, parallel to the conveying direction.

4. The apparatus for the distribution according to claim 3, wherein, at the control and/or reading station, the C-section guide rails are mounted on elastic supports pressing at least one guide branch against one edge of the cards.

5. The apparatus for the distribution according to claim 3, wherein the transition between the sections is provided by the continuity of the guide rails following a helical sector suspended by clamps.

6. The apparatus for the distribution according to claim 1, wherein the cards are pushed by L-shaped pushing members, so as to push the cards both when they are horizontally and vertically arranged.

7. The apparatus for the distribution according to claim 1, wherein the control and/or reading station of the card comprises an optical recognition system for both the sides of the card.

8. The apparatus for the distribution according to claim 7, wherein the optical recognition system comprises two digital optical readers configured to read bar codes and/or alphanumeric strips.

9. The apparatus for the distribution according to claim 8, wherein the two digital optical readers are further configured to read bar MRTD-type codes.

10. The apparatus for the distribution according to claim 1, wherein the control and/or reading station of the card comprises a magnetic strip reading device, of the sliding type.

11. The apparatus for the distribution according to claim 1, wherein the control and/or reading station of the card comprises at least one chip reader device 46 for smart cards.

12. The apparatus for the distribution according to claim 1, wherein the control and/or reading station of the card comprises a RFID-type reading device.

13. The apparatus for the distribution according to claim 1, wherein, at said coupling means, the cards are sucked by a pneumatic vacuum so as to not hinder the coupling means.

14. The apparatus for the distribution according to claim 1, wherein said coupling means are composed by a pick-and-place device, apt to capture one or more cards and to lay them down on the exposed surface of the paper carrier.

15. The apparatus for the distribution according to claim 1, wherein said pick-and-place device has two vertical rotation axis (A, B), a variable length arm movable on a horizontal plane and a picking member able to translate vertically, the combination of these degrees of freedom making the pick-and-place device suitable to pick one or more cards and to lay them down on the paper carrier in any point of the exposed surface, with any angle.

16. The apparatus for the distribution according to claim 15, wherein the path of the picking member is programmed so as to end a race thereof with a vertical segment, at least with respect to the carrier.

17. The apparatus for the distribution according to claim 1, wherein the pick-and-place device comprises an arm revolving around a first axis (A), said arm having a variable length, the working end of the arm comprising a picking member arranged on a sliding vertical bar, so that the picking element is able to vertically translate along a second axis (B), the vertical bar 34 being pivotable, and wherein the card can be rotated after the picking thereof.

18. The apparatus for the distribution according to claim 1, wherein, following to the coupling means, a second control and reading station is comprised, provided with an optical means for verifying the correctness of the operated coupling.

19. An enveloping apparatus comprising:

the apparatus for the distribution according to claim 1.

20. The enveloping apparatus according to claim 19, comprising a paper carrier feeding station, a card feeding station, a folding station and an enveloping station.

21. The enveloping apparatus according to claim 19, wherein the paper carrier feeding station provides apparatus for the distribution with a discrete sequence of paper carriers in the shape of sheets.

22. The enveloping apparatus according to claim 21, wherein the paper carrier feeding station comprises a printing device configured to operate on discrete sheets, on endless form sheets, on a paper bobbin, or on single pre-printed and stacked sheets.

23. The enveloping apparatus according to claim 21, wherein the paper carrier feeding station comprises a cutting device acting longitudinally and transversally.

24. The enveloping apparatus according to claim 21, wherein the paper carrier feeding station comprises a folding and/or creasing station.

25. The enveloping apparatus according to claim 19, wherein, between the folding station and the enveloping station an expulsion device is provided for the carriers having a wrong coupling, comprising a flap arranged transversally with respect to the conveying direction of the carriers.

26. The enveloping apparatus according to claim 19, wherein, between the folding station and the enveloping station, one or more buffers are provided, operated for synchronizing the flow of carriers and the flow of envelopes and for accumulating more carriers intended to be enveloped together.

27. The enveloping apparatus according to claim 19, which is controlled by a control system provided with a data storage containing a database with the data of the cards combined with the addresses of the intended recipients.

* * * * *

UNITED STATES PATENT AND TRADEMARK OFFICE

CERTIFICATE OF CORRECTION

PATENT NO. : 8,437,872 B2
APPLICATION NO. : 12/529609
DATED : May 7, 2013
INVENTOR(S) : Alessandro Prataiola It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 739 days.

Signed and Sealed this
Eighth Day of September, 2015

Michelle K. Lee

Michelle K. Lee
*Director of the United States Patent and Trademark Office*